US009941561B2

(12) United States Patent
Wolfson et al.

(10) Patent No.: US 9,941,561 B2
(45) Date of Patent: Apr. 10, 2018

(54) SYSTEMS AND METHODS FOR HIGH POWER RF CHANNEL SELECTION

(71) Applicant: Technology Service Corporation, Silver Spring, MD (US)

(72) Inventors: Brandon Joseph Wolfson, Huntsville, AL (US); Douglas Don Fitzpatrick, Huntsville, AL (US)

(73) Assignee: Technology Service Corporation, Silver Spring, MD (US)

( * ) Notice: Subject to any disclaimer, the term of this patent is extended or adjusted under 35 U.S.C. 154(b) by 0 days.

(21) Appl. No.: 15/160,437

(22) Filed: May 20, 2016

(65) Prior Publication Data

US 2016/0344105 A1 Nov. 24, 2016

Related U.S. Application Data

(63) Continuation of application No. 13/665,044, filed on Oct. 31, 2012, now abandoned.

(60) Provisional application No. 61/553,661, filed on Oct. 31, 2011.

(51) Int. Cl.

| | |
|---|---|
| ***H01P 1/12*** | (2006.01) |
| ***H01P 1/15*** | (2006.01) |
| ***H01P 5/18*** | (2006.01) |
| ***H01Q 5/50*** | (2015.01) |
| ***H01Q 1/36*** | (2006.01) |

(Continued)

(52) U.S. Cl.

CPC ..... *H01P 1/127* (2013.01); *H01P 1/15* (2013.01); *H01P 5/187* (2013.01); *H01Q 1/36* (2013.01); *H01Q 1/48* (2013.01); *H01Q 5/50* (2015.01); *H01Q 15/002* (2013.01)

(58) Field of Classification Search

CPC ..... H01P 1/10; H01P 1/15; H01Q 15/002; H01Q 5/50; H01Q 1/127; H01Q 1/15; H01Q 5/187; H01Q 1/36; H01Q 1/48

USPC ..... 333/101, 103, 262, 111, 116, 17.1, 109, 333/113, 115; 330/129, 279; 455/116, 455/126, 127

See application file for complete search history.

(56) References Cited

U.S. PATENT DOCUMENTS

| | | | | |
|---|---|---|---|---|
| 3,659,227 A | | 4/1972 | Whistler | |
| 4,791,421 A | * | 12/1988 | Morse | H01Q 21/0025 342/368 |
| 5,363,071 A | | 11/1994 | Schwent et al. | |

(Continued)

FOREIGN PATENT DOCUMENTS

WO WO 0180349 A1 10/2001

OTHER PUBLICATIONS

Petropoulos et al. "Phased Array Antenna Receives 4G Networks", Microwaves & RF, Nov. 2012, pp. 1-12.*

*Primary Examiner* — Benny Lee
*Assistant Examiner* — Hafizur Rahman
(74) *Attorney, Agent, or Firm* — Finnegan, Henderson, Farabow, Garrett & Dunner, LLP

(57) ABSTRACT

A switch is disclosed for selecting a port. The switch includes a dielectric layer, a first circuit, and a second circuit. The first and second circuits are disposed on the dielectric layer and electrically coupled to each other through the dielectric layer. The first circuit includes a set of ports. The switch further includes a control port for receiving a control signal and a plurality of switching elements. The control signal selects at least one of the set of ports to be connected to the second circuit by setting operational states of the plurality of switching elements.

15 Claims, 7 Drawing Sheets

(51) Int. Cl.
*H01Q 1/48* (2006.01)
*H01Q 15/00* (2006.01)

(56) References Cited

U.S. PATENT DOCUMENTS

| | | | |
|---|---|---|---|
| 5,834,990 | A | 11/1998 | Hahn et al. |
| 6,714,169 | B1 | 3/2004 | Chau et al. |
| 2003/0020664 | A1 | 1/2003 | Thudor et al. |
| 2003/0034929 | A1 | 2/2003 | Bolzer et al. |
| 2005/0285809 | A1 | 12/2005 | Louzir et al. |
| 2006/0077028 | A1 | 4/2006 | Huang |
| 2008/0290962 | A1 | 11/2008 | Kim et al. |
| 2010/0194493 | A1 | 8/2010 | Thompson |
| 2010/0246454 | A1 | 9/2010 | Ansari et al. |

* cited by examiner

SYSTEMS AND METHODS FOR HIGH POWER RF CHANNEL SELECTION

FIELD OF THE INVENTION

This disclosure relates in general to phased array antennas and in particular to high power RF channel selection in phased array antennas.

BACKGROUND OF THE INVENTION

Phased array antennas are a major part of today's military and commercial sensors and communication systems. In phased array antennas, multiple antennas are often configured together into an antenna array to form a directional radiation pattern. More advanced phased arrays use phase shifting techniques to scan their radiation patterns in space. A phased array usually comprises a number of dipole antenna elements, commonly spaced at a equal distance. Each element or sub array of elements are connected to a phase shifter followed by a summing node. Varying the frequency of operation can also be used in lieu of the phase shifters to form the radiation pattern.

Active phased arrays or active electronically scanned arrays (AESAs) include amplifiers at individual antenna elements or subarrays of the antenna array. Compared with passive phased arrays, active phased arrays provide greater sensitivity. In addition, AESAs are more reliable than mechanically scanned antennas. An active phased array system front end typically comprises antennas and Transmit/Receive (T/R) modules. A primary reoccurring cost of an active phased array system is for the T/R modules. The cost of the T/R modules stems from a number of high dollar components required for each T/R module, including switches, amplifiers, phase shifters, variable attenuators, etc., which are multiplied by the total number of T/R modules used in the array. When arrays can have hundreds or even thousands of elements and T/R modules, the number of components, their associated costs, and the dissipated power have a significant impact on the overall performance and cost of the array.

An active phased array's effective radiated power and overall RF system capability are determined largely by the array's transmitted RF power. Therefore, the T/R module and its amplifiers are designed to achieve as much transmitted power as possible. The transmitted power level may be increased by increasing the number of antenna elements and T/R modules in the system. However, phased arrays are typically restricted to a small footprint, reducing the spatial degrees of freedom available to enhance array performance. When the array is spatially contained, the power dissipated by the T/R module may become an increasingly important issue as the number of T/R modules increases. The available space and heat removal capability may limit the level of transmit power that an active phased array can realistically achieve.

Operating at RF and microwave frequencies, the T/R module usually employs Monolithic Microwave Integrated Circuit (MMIC) components to reduce the footprint. As the transmit power becomes greater, the output switch of the T/R module may become more costly and limiting in its performance. The higher the output power, the fewer switches on the market available capable of handling the output power, and the more costly they may become. Many amplifiers are available for use in a T/R module that can deliver more output power than can be handled by any conventional switch. Also, the signal losses through the conventional switch may be substantial enough to impact the transmitted power and the amount of power dissipated as heat. Thus, a low-cost output switch that is capable of transmitting high power level, while reducing power losses, is greatly desired.

SUMMARY OF THE INVENTION

In accordance with some embodiments, a switch is disclosed for selecting a port. The switch includes a dielectric layer, a first circuit, and a second circuit. The first and second circuits are disposed on the dielectric layer and electrically coupled to each other through the dielectric layer. The first circuit includes a set of ports. The switch further includes a control port for receiving a control signal and a plurality of switching elements. The control signal selects at least one of the set of ports to be connected to the second circuit by setting operational states of the plurality of switching elements.

In accordance with some alternative embodiments, a method is disclosed for selecting a port. The method includes receiving a control signal through a control port, setting operational states of a plurality of switching elements according to the control signal, selecting one of a set of ports coupled to a first circuit according to the operational states of the switching elements, and transmitting signals between the selected port and a second circuit.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to embodiments of the disclosure, examples of which are illustrated in the accompanying drawings. Wherever possible, the same reference numbers will be used throughout the drawings to refer to the same or like parts.

Figure 1:
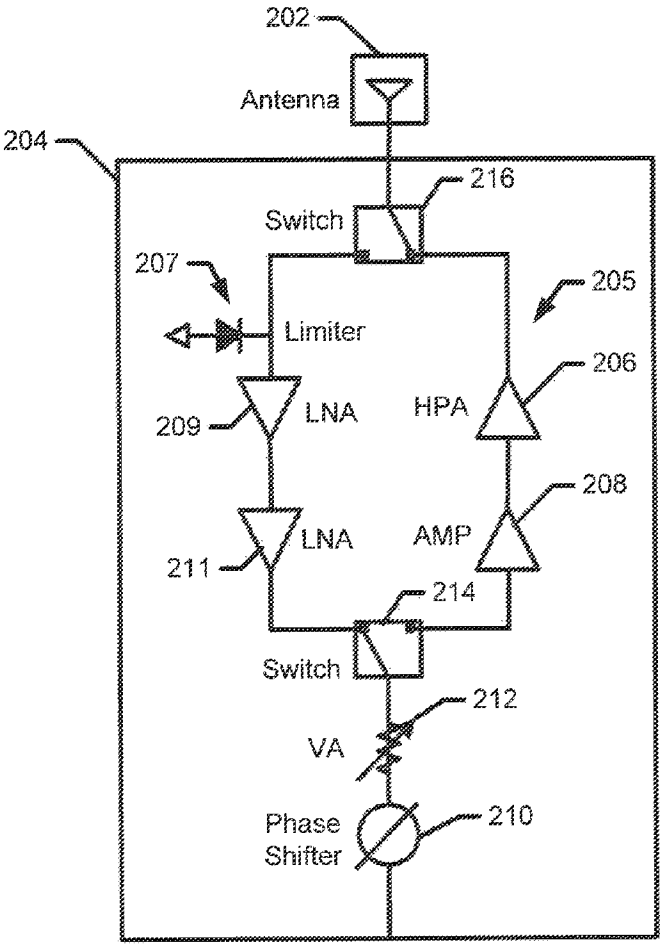
FIG. 1 is a diagram of an exemplary embodiment of a Transmit/Receive (T/R) module for an active phased array antenna.

FIG. 1 depicts one exemplary embodiment of an active phased array element 200 including an antenna 202 a Transmit/Receive (T/R) module 204. T/R module 204 includes a transmitting channel 205 and a receiving channel 207. Transmitting channel 205 includes one or more high power amplifiers (HPAs) 206 and one or more amplifiers (AMPs) 208 to amplify signals to be radiated by antenna 202 to a high power level suitable for transmission. Receiving channel 207 includes one or more low noise amplifiers (LNAs) 209 and 211 to amplify signals received through antenna 202 and set a receiving sensitivity of T/R module 204.

T/R modules 204 also includes a phase shifter 210 and other amplitude control components 212, which may be incorporated into the amplifiers. Amplitude control components 212 are configured to optimize the amplitude contribution from each element across the array. This is called amplitude weighting or tapering. Amplitude weighting is used to suppress unwanted side lobes in the radiation pattern.

To allow for bi-directional signal flow for transmitted and received waveforms, T/R module 204 further includes an input switching component 214 and an output switching component 216 at its input and output, respectively. Switching components 214 and 216 may be switches, circulators, diplexers, combinations thereof, or comparable components providing a comparable function. Input switching component 214 selects transmitting channel 207 or receiving channel 205 of T/R module 204 and connects them to subsequent processing components within the phased array antenna. Thus, switching components 214 and 216 may be set to configure T/R module 204 in a receiving state or a transmitting state.

Figure 2:
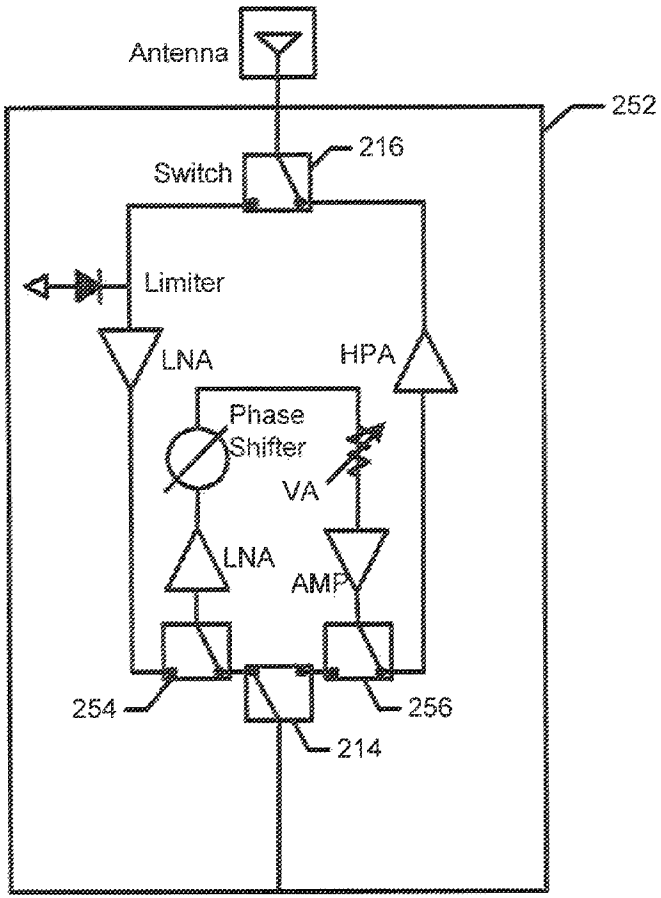
FIG. 2 is a diagram of an alternative embodiment of a T/R module for an active phased array antenna.

FIG. 2 depicts another exemplary embodiment of T/R module 252. In FIG. 2, T/R module 252 includes similar elements as those depicted in FIG. 1. In addition, T/R module 252 includes additional switching components 254 and 256 at the input of T/R module 252. Switching components 214, 216, 254, and 256 may be set to configure T/R module 252 in the receiving state or the transmitting state.

Figure 3B:
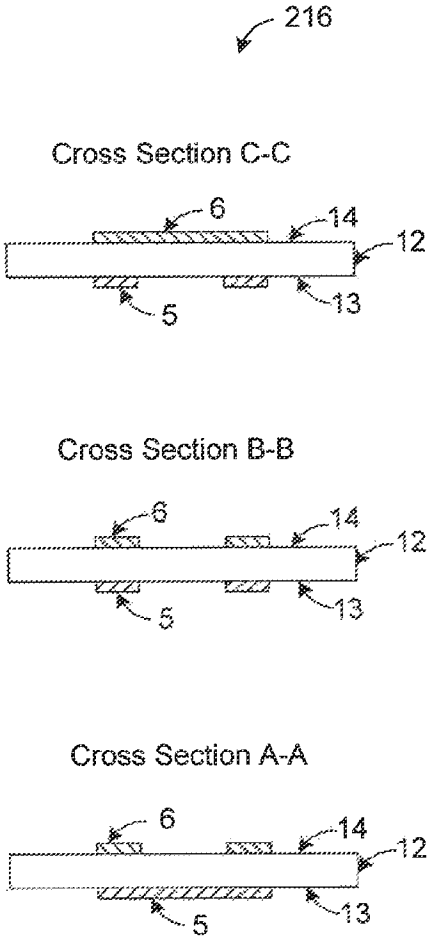
FIG. 3B is a diagram of cross-sectional views of the switching component of FIG. 3A.
Figure 3A:
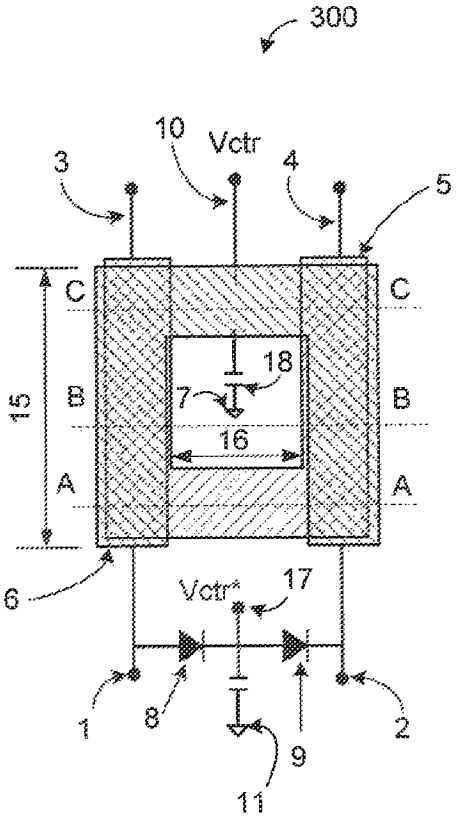
FIG. 3A is a diagram of an exemplary embodiment of a switching component.

FIGS. 3A and 3B depict an exemplary embodiment of an output switching component 300 generally corresponding to switching component 216 of FIGS. 1 and 2. Switching component 300 includes circuits in the form of metalized traces 5 and 6, disposed on a first surface 13 and a second surfaces 14 of a dielectric layer 12 of a specified thickness. For ease of illustration, in FIG. 3A, dielectric layer 12 is not shown, and trace 6 is depicted as semi-transparent to reveal the shape of trace 5. In addition, switching component 300 also includes input/output ports or terminals 1-4. Ports 1 and 2 are coupled to trace 6, while ports 3 and 4 are coupled to trace 5. Thus, traces 5 and 6 form a pair of broad wall coupled lines and are electrically coupled to each other through dielectric layer 12.

The widths of traces 5 and 6 are shown to be slightly different only for ease of visualization of the circuit. The actual widths of traces 5 and 6 and the thickness of dielectric layer 12 between them may be determined according to the materials used and the performance requirements, such as the desired frequency of operation, the desired input and output impedances of ports 1-4, etc. Traces 5 and 6 each have a "U" shape with an outer dimension 15 approximately equal to ¼ of a wavelength at the desired frequency of operation. Outer dimension 15 is measured from an opening end of the "U" shape to a closed end of the "U" shape. An inner dimension 16 of traces 5 and 6 may be optimized during a tuning of the circuit and is generally minimized to provide desired performance such as a high signal bandwidth. In addition, traces 5 and 6 may substantially overlap each other, while the opening ends of the "U" shapes of traces 5 and 6 are oriented in opposite directions.

Switching component 300 further includes a control node 10 coupled to trace 6 for receiving a control signal $V_{ctr}$ and a ground node 7 coupled to trace 6 for connecting switching component 300 to an RF ground. Control signal $V_{ctr}$ may be a DC control signal with a suitable voltage level. Node 7 is electrically isolated from DC signals and control signal $V_{ctr}$ and couples trace 6 to an RF ground. This can be accomplished by disposing between trace 6 to and node 7 an appropriate capacitor or through an RF quarterwave open ended stub, an open ended radial stub, or other components known in the art to provide similar functionalities.

Switching component 300 further includes switching elements 8 and 9 connected between ports 1 and 2. Switching elements 8 and 9 may be diodes, diode-connected transistors, or other suitable circuit elements that may be switched between "on" and "off" states. Switching components 8 and 9 may be connected in series between ports 1 and 2. The common node between switching elements 8 and 9 is grounded through a ground node 11. According to one embodiment, ground node 11 may be both an RF and a DC ground. The DC ground may be obtained through a via or a through hole in a circuit board. The RF ground may use the via of the DC ground or be obtained by the methods discussed above in connection with ground node 7. Alternatively, ground note 11 may be an RF ground only and is isolated from DC signals through a capacitor.

Still additionally or alternatively, switching component 300 may further include a control node 17 for receiving control signal $V_{ctr}$*. Control signal $V_{ctr}$* may be a DC signal with an appropriate voltage level.

In one embodiment, control signal $V_{ctr}$ is provided through control node 10 to control the operational states of switching elements 8 and 9. For example, control signal $V_{ctr}$* may be kept at a constant voltage level or a DC ground level, control signal $V_{ctr}$ may then set switching elements 8 and 9 to the "on" or "off" state according to the voltage level of the control signal $V_{ctr}$. In the "on" state, switching elements 8 and 9 present a low RF impedance to the circuit and, in the "off" state, switching elements 8 and 9 present a high RF impedance to the circuit.

In one embodiment, when the control signal $V_{ctr}$ is set to a first voltage level, switching element 8 is biased in the "on" state and switching element 9 in the "off" state. As a result, port 2 is disconnected from the ground and thus selected for connection with ports 3 and 4, and port 1 is grounded through switching element 8 and thus disabled. Under these conditions, switching component 300 may operate as a signal splitter. For example, if an RF signal is input into port 2, it is equally split between ports 3 and 4 and output therefrom. The signals output from ports 3 and 4 are approximately 180 degrees out of phase from each other. According to a further embodiment, the first voltage level may be any voltage level sufficiently greater than the ground level or the voltage level of control signal $V_{ctr}$*.

Alternatively, switching component 300 may also operate as a signal combiner. In particular, when respective signals are input into ports 3 and 4 with 180 degrees of phase difference between them, a combination of these two signals is output from port 2. When switching component 300 operates as the signal splitter or the signal combiner, port 1 is disabled or isolated from the rest of the circuit and, thus, has negligible power going into or out of it.

In another embodiment, when control signal $V_{ctr}$ is set to a second voltage level, switching element 9 may be biased in the "on" state and switching element 8 in the "off" state. Under these conditions, switching component 216 may operate as a signal splitter. For example, if an RF signal is coupled to port 1, it is equally split between ports 3 and 4. Similarly, the signals from ports 3 and 4 are approximately 180 degrees out of phase from each other. On the other hand, if two RF signals are coupled to ports 3 and 4 with 180 degrees of phase difference between them, a combination of these two signals is output through port 1. In this case, port 2 becomes disabled and isolated from the rest of the circuit. According to a further embodiment, the second voltage level may be any voltage level sufficiently lower than the ground level or the voltage level of control signal $V_{ctr}$*.

Ports 3 and 4 form a balanced pair of ports. Accordingly, switching component 300 connects the balanced pair of ports (e.g., ports 3 and 4) to a user-selectable single port (e.g., port 1 or 2) according to control signal $V_{ctr}$.

Alternatively, the voltage levels of control signals $V_{ctr}$ and $V_{ctr}$* may both be varied to select port 1 or port 2. For example, when control signal $V_{ctr}$ has a voltage level sufficiently greater than that of control signal $V_{ctr}$*, switching element 8 is turned on, while switching element 9 is turned off. Thus, port 2 is selected and connected to ports 3 and 4. When control signal $V_{ctr}$ has a voltage level sufficiently lower than that of control signal $V_{ctr}$*, switching element 8 is turned off while switching element 9 is turned on. Thus, port 1 is selected and connected to ports 3 and 4.

As depicted in FIGS. 1 and 2, switching component 300 may be integrated in a T/R module of a phased array antenna. In particular, ports 3 or 4 of switching component 300 may be connected to an antenna element, such as a printed dipole, that requires balanced inputs. Ports 1 and 2 are connected, respectively, to the transmitting channel and the receiving channel of the T/R module. Control signal $V_{ctr}$ or the combination of control signals $V_{ctr}$ and $V_{ctr}$* allows a selection between the transmitting channel and the receiving channel to be connected to the antenna element and therefore takes the functional place of a conventional output switch.

To produce the equal split of signal power with 180 degrees phase difference at ports 3 and 4, appropriate even and odd mode impedances are designed for the coupled trace sections of switching component 300. The circuit of switching component 300 is generally separated from a ground plane at a distance that is several times that of the distance between the coupled traces 5 and 6. This allows the odd mode impedance to be sufficiently lower than the even mode impedance. This design provides the electromagnetic fields to be primarily coupled between traces 5 and 6, instead of between either of these traces and the ground plane. This is generally desired for proper design and operation.

The width of traces 5 and 6 and the space between them may determine the odd mode impedance in the circuit of switching component 300. According to one embodiment, the circuit shown in FIGS. 3A and 3B operates as a 1:1 or 2:1 impedance transformer. The odd mode impedance, which is a single ended impedance with respect to ports 3 and 4, may be set to be half of the desired input impedance at ports 1 and 2. Alternatively, the odd mode impedance may be set to be the impedance needed at ports 3 and 4, and the impedances at ports 1 and 2 are each approximately twice the odd mode impedance. Still alternatively, the circuit of FIGS. 3A and 3B may also be designed to have less or greater than a 2:1 impedance transformation ratio if desired.

As discussed above, dimension 15 of traces 5 and 6 may be determined according to the wavelength of the signal at the desired frequency of operation, whereas dimension 16 is generally minimized. In addition, minimizing dimension 16 may cause the signals output from ports 3 and 4 to be substantially 180 degrees out of phase when switching component 216 operates as a signal splitter. Other dimensions of traces 5 and 6 are determined according to the performance requirement of switching component 216, such as bandwidth, impedance, available space on the circuit board, etc.

Figure 4:
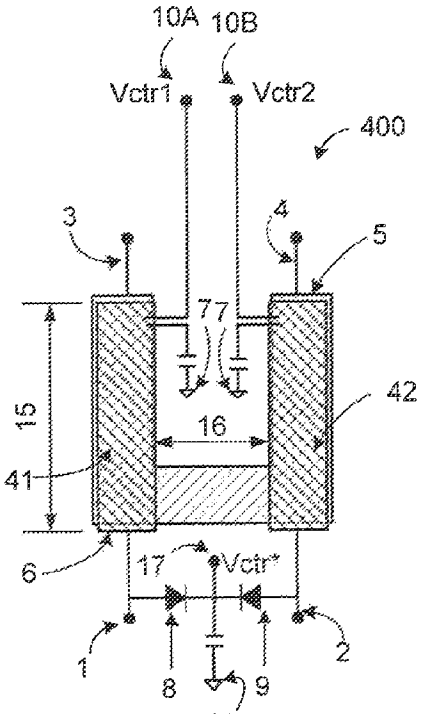
FIG. 4 is a diagram of an alternative embodiment of a switching component.

FIG. 4 illustrates an alternative embodiments of switching component 400 similar to that depicted in FIGS. 3A and 3B. In particular, switching component 400 in FIG. 4 includes circuits in the form of traces 5 and 6 disposed on a dielectric layer 12, which is not shown for ease of illustration. Trace 5 has a "U" shape similar to that shown in FIG. 3A. Similar to FIG. 3A, trace 5 is coupled to ports 3 and 4, which provide balanced inputs to, for example, an antenna element connected thereto.

Trace 6 may include two separate sections 41 and 42, each corresponding to and overlapping a respective portion of trace 5. Sections 41 and 42 of trace 6 are coupled to the RF ground through ground nodes 7 and to corresponding control nodes 10A and 10B for receiving respective control signals $V_{ctr1}$ and $V_{ctr2}$. In addition, sections 41 and 42 of trace 6 are coupled to ports 1 and 2, respectively. Switching element 8 and 9 are connected between ports 1 and 2, with the cathodes (or their equivalents) of switching elements 8 and 9 coupled to a common node, which is connected to the ground through ground node 11. Ports 1 and 2 may be respectively coupled to the transmitting channel and the receiving channel of a T/R module similar to those shown in FIGS. 1 and 2. Additionally, the common node between switching elements 8 and 9 may be coupled to an additional control node 17 for receiving control signal $V_{ctr}$*.

Switching component 400 may select port 1 or port 2 for connection with ports 3 and 4 according to control signals $V_{ctr1}$, $V_{ctr2}$, and $V_{ctr}$*. For example, when control signal $V_{ctr1}$ has a voltage level sufficiently greater than that of control signal $V_{ctr}$*, and the voltage level of $V_{ctr2}$ is sufficiently lower than that of control signal $V_{ctr}$*, port 2 is selected and connected to ports 3 and 4, while port 1 is disabled and isolated from the circuit. As a result, switching component 400 shown in FIG. 4 may operate as a signal splitter, which receives a signal from port 2 and outputs signals through ports 3 and 4, which are 180 degrees out of phase. On the other hand, switching component 216 may operate as a signal combiner, which receives signals through ports 3 and 4, which are 180 degrees out of phase, and generates an output signal through port 2.

Similarly, when control signal $V_{ctr1}$ has a voltage level sufficiently lower than that of control signal $V_{ctr}$*, and the voltage level of control signal $V_{ctr2}$ is sufficiently greater than that of control signal $V_{ctr}$*, port 1 is selected and connected to ports 3 and 4, while port 2 is disabled and isolated from the circuit. As a result, switching component 216 may operate as a signal splitter, which receives a signal from port 1 and outputs signals through ports 3 and 4, which are 180 degrees out of phase. On the other hand, switching component 216 may also operate as a signal combiner, which receives signals through ports 3 and 4, which are 180 degrees out of phase, and generates a combined signal through port 1.

Figure 5:
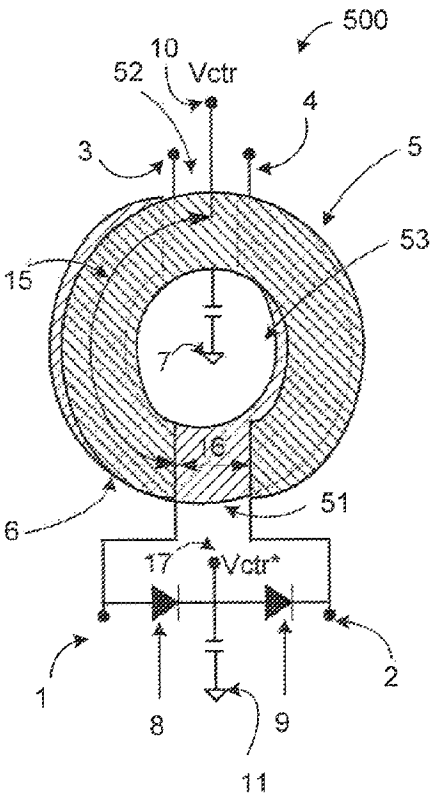
FIG. 5 is a diagram of a still alternative embodiment of a switching component.

FIG. 5 shows another embodiment of switching component 500. Similar to the embodiment shown in FIG. 3A, switching component 500 in FIG. 5 may also include circuits in the form of traces 5 and 6 disposed on a dielectric layer, which is not shown for ease of illustration. Traces 5 and 6 may each have a disc shape having a cutout (51 and 52) along a radial direction. In addition, traces 5 and 6 may overlap each other, while cutouts 51 and 52 of traces 5 and 6 may be oriented in opposite directions. Cutouts 51 and 52 each have a dimension 16, which is minimized to ensure performance of switching component 216, but may also be set according to other factors such as the shape and length of traces 5 and 6 and available spaces on a circuit board.

Trace 5 and 6 may have substantially the same dimension 15 as depicted in FIG. 5. Dimension 15 may be measured along a circumferential direction from an edge of cutout 51 or 52 to a middle point of trace 5 or 6. Dimension 15 preferably is approximately equal to ¼ of a wavelength of a signal at the desired operational frequency. Each of traces 5 and 6 has a center opening 53, which may be formed as an extension of respective cutouts 51 and 52.

Trace 6 in FIG. 5 is coupled to an RF ground through a capacitor and a ground node 7 and receives a control signal $V_{ctr}$ through a control node 10. In addition, ports 3 and 4 are coupled to trace 5 through respective end sections of cutout 52, while ports 1 and 2 are coupled to trace 6 through respective end sections of cutout 51.

Switching elements 8 and 9 are coupled in series between ports 1 and 2. The common node between switching elements 8 and 9 is grounded through a ground node 11 and an appropriate element such as those described above. Additionally, the common node between switching elements 8 and 9 may be further connected to a control port 17 for receiving control signal $V_{ctr}$*.

Similar to the embodiment depicted in FIG. 3A, switching component 500 of FIG. 5 selects one of ports 1 and 2 to be connected to ports 3 and 4 according to the control signal $V_{ctr}$ or the combination of control signals $V_{ctr}$ and $V_{ctr}$*. In addition, switching component 500 allows signals to flow in both directions between ports 3 and 4 and the selected one of ports 1 and 2. When integrated in a T/R module such as those depicted in FIGS. 1 and 2, switching component 500 is coupled to an antenna element through ports 3 and 4, which provide balanced inputs to the antenna element, and coupled to the transmitting channel and the receiving channel of the T/R module through ports 1 and 2, respectively.

During operation, switching component 500 may receive signals from port 1 or 2, selected according to the control signal $V_{ctr}$ and/or control signal $V_{ctr}$*, and generate output signals from ports 3 and 4 that are 180 degrees out of phase. Switching component 500 may also receive input signals from ports 3 and 4 that are 180 out of phase and generate output signal from port 1 or 2 selected according to the control signals.

Figure 6:
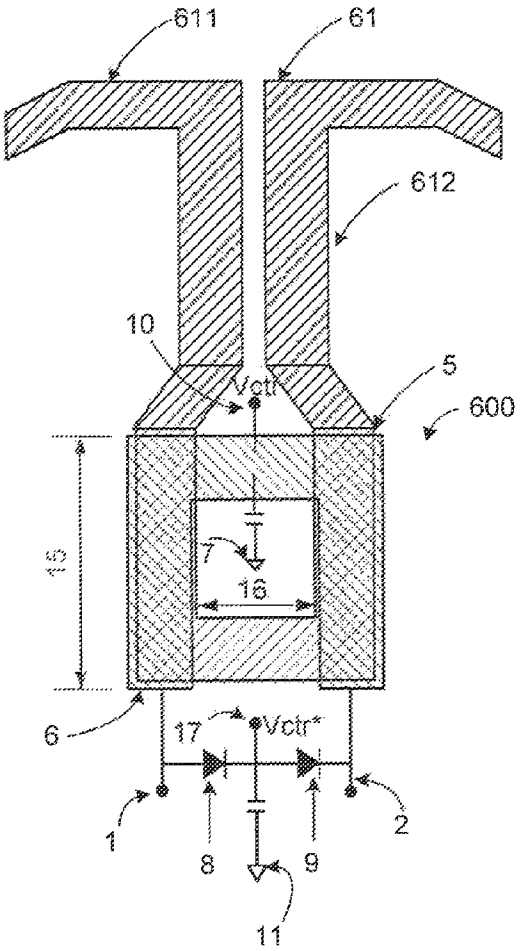
FIG. 6 is a diagram of a still alternative embodiment of a switching component.

FIG. 6 depicts a further alternative embodiment of switching component 600 integrated with a printed antenna 61. In particular, printed antenna 61 may include a first section 611 and a second section 612, each integrated with and formed as an extension of the "U" shape of trace 5. As a result, ports 3 and 4 are omitted. Switching component 600 may receive signals from or transmit signals to antenna 61 without intervening components.

Similar to the embodiment depicted in FIG. 3A, switching component 600 of FIG. 6 may select port 1 or 2 according to control signal $V_{ctr}$ or the combination of signals $V_{ctr}$ and $V_{ctr}$* and connect the selected port to antenna 61. In particular, switching component 216 may receive a signal from a T/R module through the selected one of port 1 or 2, split the received signal into two signal components that are 180 degrees out of phase, and transmit the two signal components to sections 611 and 612 of antenna 61, respectively. Alternatively, switching component 216 may receive two signals, which are 180 degrees out of phase, from sections 611 and 612 of antenna 61, generate a combined signal at the selected port, and transmit the combined signal to the T/R module connected thereto.

Figure 7:
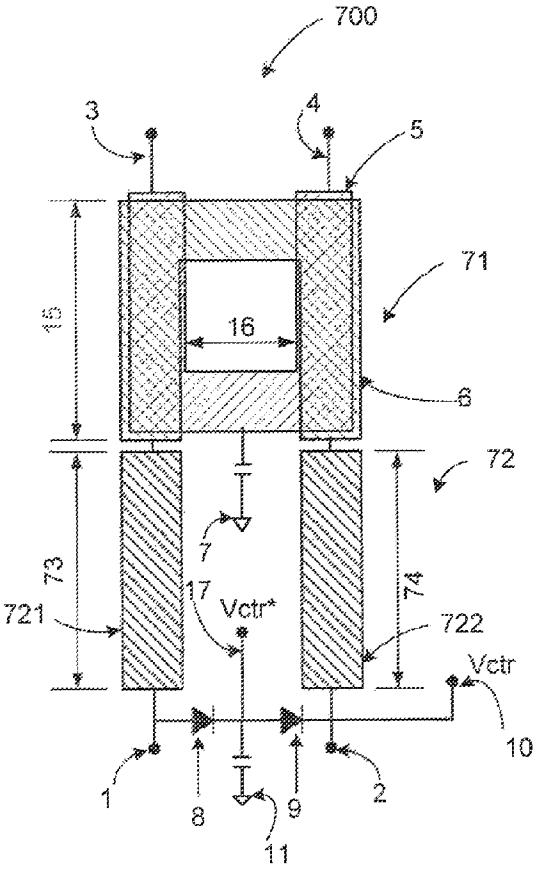
FIG. 7 is a diagram of a still alternative embodiment of a switching component.

FIG. 7 depicts a further alternative embodiment of switching component 700. In particular, switching component 700 has a first section 71 and a second section 72. First section 71 has a structure similar to that depicted in FIGS. 3A and 3B, including traces 5 and 6 disposed on a dielectric layer. Trace 5 is coupled to an RF ground through a ground node 7.

Second section 72 may include a first trace 721 and a second trace 722, each coupled to the "U" shape of trace 6 in first section 71. First and second traces 721 and 722 may be disposed on the same surface of the dielectric layer as trace 6. Ports 3 and 4 may be coupled to the "U" shape of trace 5, while ports 1 and 2 may be coupled to the first and second traces 721 and 722. Switching elements 8 and 9 are disposed between ports 1 and 2 in series, with the common node between switching elements 8 and 9 coupled to the RF ground through ground node 11. In addition, the common node between switching elements 8 and 9 may be coupled to control node 17 for receiving control signal $V_{ctr}$*. Additionally, port 1 or port 2 may be further connected to a control node 10 for receiving control signal $V_{ctr}$.

First section 71 of switching component 700 may be substantially similar to the switching component depicted in FIG. 3A. In second section 72, traces 721 and 722 may have lengths 73 and 74 substantially equal to outer dimension 15 of first section 71, which is approximately ¼ of a wavelength of a signal at the operational frequency. Traces 721 and 722 may each have a width, which may or may not be substantially equal to that of trace 5 or 6. The widths of traces 721 and 722 may be determined according to performance requirements of the circuit such as the impedance.

During operation, switching component 700 receives control signal $V_{ctr}$ through control node 10 and selects port 1 or 2 according to control signal $V_{ctr}$ for connection with ports 3 and 4. In particular, when control signal $V_{ctr}$ has a first voltage level that is sufficiently greater than that of control signal $V_{ctr}$*, switching element 8 is turned on and switching element 9 is turned off. As a result, port 2 is selected and connected to ports 3 and 4, while port 1 is disabled. In addition, trace 721 of second section 71 further isolates disabled port 1 from the rest of the circuit by presenting an open circuit to first section 71 and a low impedance at the input of the circuit.

Alternatively, when control signal $V_{ctr}$ has a second voltage level that is sufficiently lower than that of control signal $V_{ctr}$*, switching element 8 is turned off and switching element 9 is turned on. As a result, port 1 is selected and connected to ports 3 and 4, while port 2 is disabled. Trace 722 of second section 72 further isolates disabled port 1 from the rest of the circuit by presenting an open circuit to first section 71. In addition, switching component 700 may operate as a signal combiner or a signal splitter as described above. According to a further embodiment, the first voltage level may be any voltage level sufficiently greater than the ground level or the voltage level present at control port 17, and the second voltage level may be any voltage level sufficiently lower than the ground level or the voltage level present at control port 17.

Still alternatively, switching component 700 may select port 1 or port 2 based on the combination of control signals $V_{ctr}$ and $V_{ctr}$*. For example, when control signal $V_{ctr}$ has a voltage level sufficiently greater than that of control signal $V_{ctr}$*, switching element 8 is turned on, while switching element 9 is turned off. Thus, port 2 is selected for connection with ports 3 and 4, while port 1 is isolated from the rest of the circuit. Alternatively, when control signal $V_{ctr}$ has a voltage level sufficiently lower than that of control signal $V_{ctr}$*, switching element 8 is turned off, while switching element 9 is turned on. Thus, port 2 is isolated from the rest of the circuit, while port 1 is selected for connection with ports 3 and 4.

Figure 8:
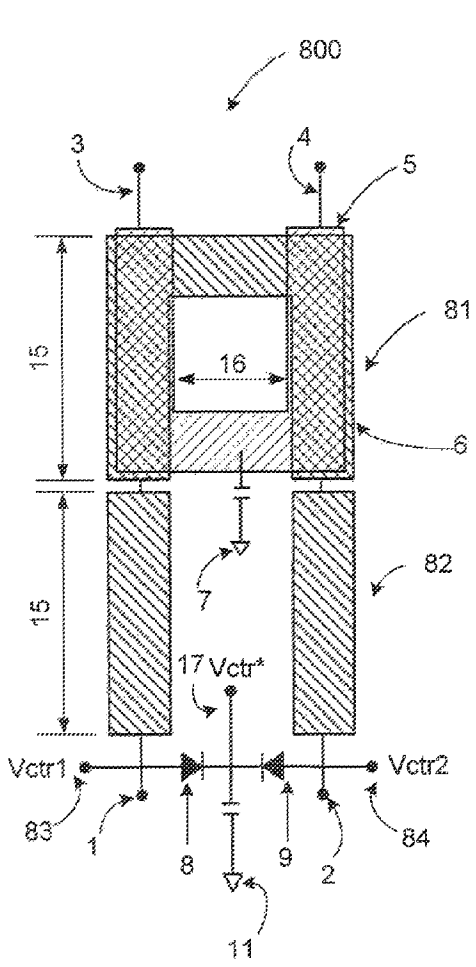
FIG. 8 is a diagram of a still alternative embodiment of a switching component.

FIG. 8 depicts a further alternative embodiment of switching component 800. Switching component 800 is similar to that depicted in FIG. 7. As shown in FIG. 8, switching component 800 may include switching elements 8 and 9 coupled between ports 1 and 2. The anodes (or their equivalents) of switching elements 8 and 9 are coupled to ports 1 and 2, respectively, while the cathodes (or their equivalents) of switching elements 8 and 9 are coupled to a common node between them, which is connected to ground node 11. In addition, switching component 800 may include a first control node 83 and a second control node 84 for receiving first and section control signals $V_{ctr1}$ and $V_{ctr2}$, respectively. First control node 83 is coupled to port 1 and the anode of switching element 8. Second control node 84 is coupled to port 2 and the anode of switching element 9. Additionally, switching component 800 may further include an additional control node 17 coupled to the common node between switching elements 8 and 9 for receiving an additional control signal $V_{ctr}$*.

According to a still alternative embodiment, switching component 800 may select port 1 or port 2 according to controls signals $V_{ctr1}$, $V_{ctr2}$, and $V_{ctr}$*. For example, when control signal $V_{ctr1}$ has a voltage level sufficiently greater than that of control signal $V_{ctr}$*, and the voltage level of $V_{ctr1}$ is sufficiently lower than that of control signal $V_{ctr}$*, switching element 8 is turned on, while switching element 9 is turned off. As a result, port 1 is disabled and isolated from the rest of the circuit, and port 2 is selected and connected to ports 3 and 4 for transmitting or receiving signals. Alternatively, when control signal $V_{ctr1}$ has a voltage level sufficiently lower than that of control signal $V_{ctr}$*, and the voltage level of control signal $V_{ctr2}$ is sufficiently greater than that of controls signal $V_{ctr}$*, switching element 8 is turned off, while switching element 9 is turned on. As a result, port 2 is disabled and isolated from the rest of the circuit, and port 1 is selected and connected to ports 3 and 4 for transmitting or receiving signals. In both cases, when port 1 or 2 is disabled, section 82 further isolates the disabled port from the rest of the circuit by presenting an open circuit to section 81 of switching component 800.

Figure 9B:
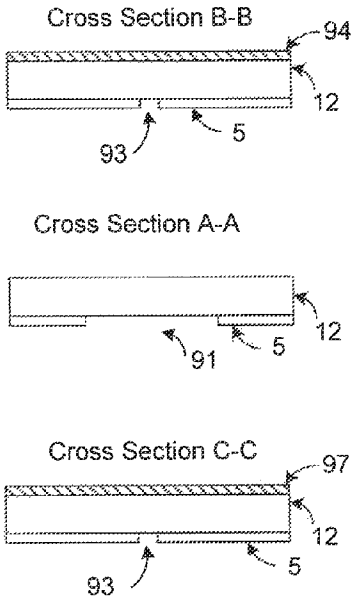
FIG. 9B is a diagram of a cross-sectional view of the switching component of FIG. 9A.
Figure 9C:
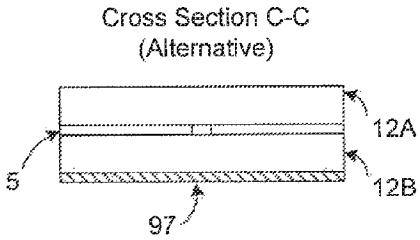
FIG. 9C is a diagram of a cross-sectional view of the switching component of FIG. 9A according to an alternative embodiment.
Figure 9A:
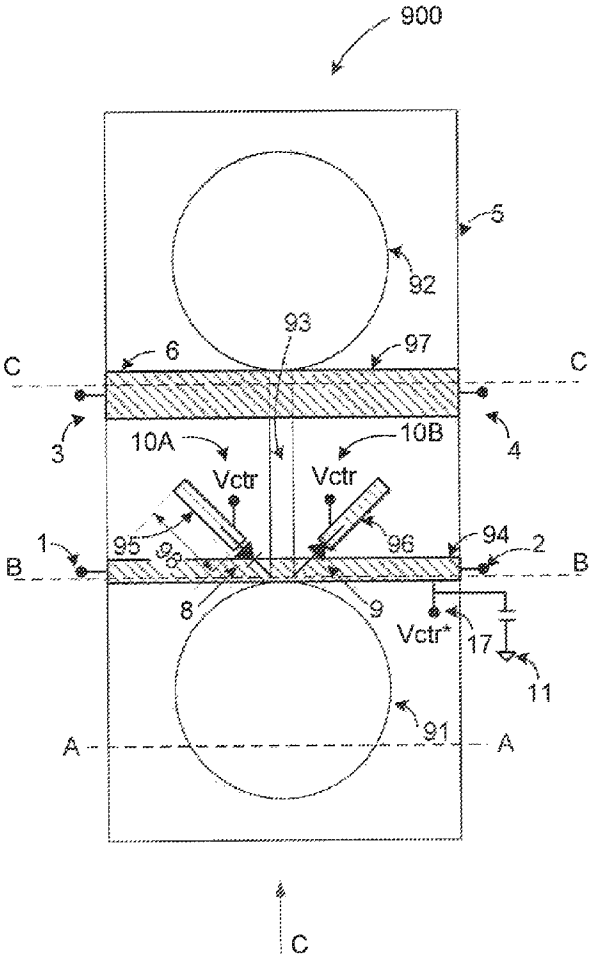
FIG. 9A is a diagram of a still alternative embodiment of a switching component.

FIGS. 9A and 9B depict a still alternative embodiment of switching component 900. Switching component 900 may include a trace 5 and a trace 6 disposed on a dielectric layer 12. For ease of illustration, dielectric layer 12 is not shown in FIG. 9A. As further shown in FIG. 9A, trace 5 is formed as a metal plate including a first circular opening 91, a second circular opening 92, and an elongated slot opening 93. Slot opening 93 connects circular openings 91 and 92.

Trace 6 may include a plurality of sections 94-97. In particular, section 94 of trace 6 may have an elongated shape, disposed proximate to circular opening 91 and perpendicular to slot opening 93. Section 97 of trace 6 may also have an elongated shape, disposed proximate to circular opening 92 and perpendicular to slot opening 93. The widths of sections 94 and 97 may be determined according to performance requirements of the switching component, such as the signal bandwidth and the input and output impedances.

According to an alternative embodiment, switching component 900 may have a multi-layer structure as depicted in FIG. 9C, in which sections 94-97 of trace 6 may be disposed on different sub-layers of the dielectric layer. In particular, the dielectric layer may include two sub-layers 12A and 12B. Trace 5 may be disposed between sub-layers 12A and 12B. Section 94-96 of trace 6 may be disposed on an outside surface of sub-layer 12A, while section 97 of trace 6 may be disposed on an outside surface of sub-layer 12B. Thus, signals maybe transmitted between traces 5 and 6 through sub-layers 12A and 12B.

Ports 1 and 2 may be coupled to respective ends of section 94 of trace 6. Ports 3 and 4 may be coupled to respective ends of section 97 of trace 6. A ground node 11 may be coupled to section 94 for connecting section 94 to a ground through a capacitor or other suitable components. In addition, a control node 17 may be coupled to section 94 for receiving a control signal $V_{ctr}$*.

Sections 95 and 96 may be open ended stubs each connected to one of switching elements 8 and 9 at one end. The free ends of sections 95 and 96 are left open to provide a closed circuit for RF signals and an open circuit for DC signals. Sections 95 and 96 have substantially similar lengths 98, which preferably are approximately equal to ¼ of a wavelength of a signal at a desired operational frequency.

Further, sections 95 and 96 may be coupled respectively to control nodes 10A and 10B for receiving control signal $V_{ctr}$. Again, control signals $V_{ctr}$ and $V_{ctr}$* may be DC signals with suitable voltage levels that properly biases switching elements 8 and 9 so as to control their operational states. Alternatively, control signal $V_{ctr}$* may be coupled to a DC ground and the switching component 900 can still operate properly.

Switching element 8 may be disposed between sections 94 and 95, with the anode (or its equivalent) of switching element 8 coupled to section 95 and the cathode (or its equivalent) of switching element 8 coupled to section 94. Switching element 9 may be disposed between sections 94 and 96, with the cathode (or its equivalent) of switching element 9 coupled to section 96 and the anode (or its equivalent) of switching element 9 coupled to section 94.

According to one embodiment, the voltage level of control signal $V_{ctr}$* is fixed during operation. This may be achieved by coupling control node 17 to a ground level.

When control signal $V_{ctr}$ has a first voltage level, switching element 8 is turned on, while switching element 9 is turned off. As a result, port 1 is disabled and isolated from the rest of the circuit, and port 2 is selected and connected to ports 3 and 4 for receiving and transmitting signals. Alternatively, when control signal $V_{ctr}$ has a second voltage, switching element 8 is turned off, while switching element 9 is turned on. As a result, port 2 is disabled and isolated from the rest of the circuit, and port 1 is selected and connected to ports 3 and 4 for receiving and transmitting signals. According to a further embodiment, the first voltage level may be any voltage level sufficiently greater than the ground level or the voltage level present at control port 17, and the second voltage level may be any voltage level sufficiently lower than the ground level or the voltage level present at control port 17.

Alternatively, switching component 900 may select port 1 or port 2 according to both control signals $V_{ctr}$ and $V_{ctr}$*. For example, when control signal $V_{ctr}$ has a voltage level sufficiently greater than that of control signal $V_{ctr}$*, switching element 8 is turned on, while switching element 9 is turned off. Thus, port 2 is selected for connection with ports 3 and 4, while port 1 is isolated from the rest of the circuit. Alternatively, when control signal $V_{ctr}$ has a voltage level sufficiently lower than that of control signal $V_{ctr}$*, switching element 8 is turned off, while switching element 9 is turned on. Thus, port 2 is isolated from the rest of the circuit, while port 1 is selected for connection with ports 3 and 4.

When integrated in a T/R module, ports 3 and 4 may be coupled to an antenna that requires a balanced input, and ports 1 and 2 may be coupled respectively to a transmitting channel and a receiving channel of the T/R module. Slot opening 93 provides a transmission path for transmitting electromagnetic signals between ports 3 and 4 and ports 1 and 2.

Figure 10:
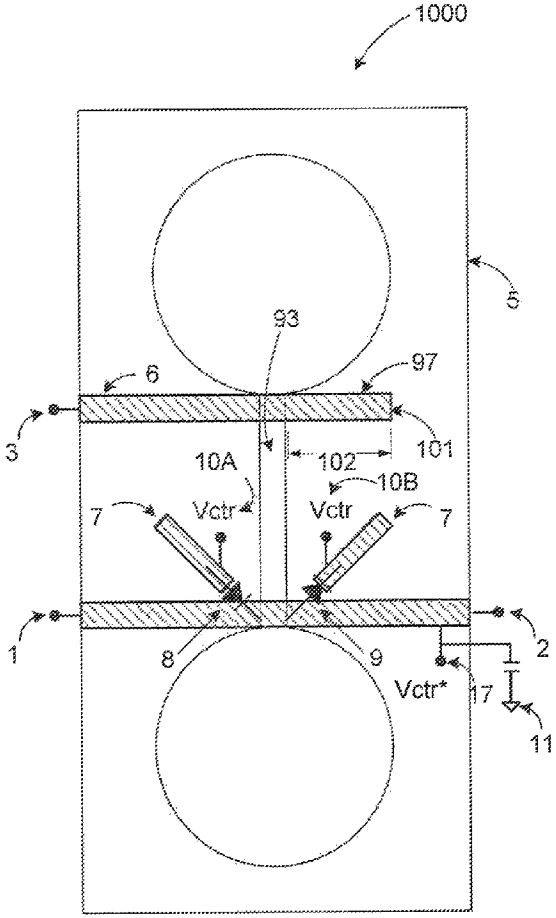
FIG. 10 is a diagram of a still alternative embodiment of a switching component.

FIG. 10 depicts a still further alternative embodiment of switching component 1000, which is similar to that depicted in FIGS. 9A and 9B, except that switching component 1000 provides a single, unbalance input/output through a signal port 3. In particular, port 3 may be coupled to section 97 of trace 6. Section 97 of trace 6 may be disposed across slot opening 93 of trace 5 and may be perpendicular to slot opening 93. A portion 101 of section 97 that crosses slot opening 93 may have a length 102, which is approximately equal to ¼ of a wavelength of a signal at the operational frequency of the circuit.

During operation, switching component 1000 of FIG. 10 may select port 1 or 2, according to control signal $V_{ctr}$ or the combination of control signals $V_{ctr}$ and $V_{ctr}$* received through control nodes 10A, 10B, and 17, and may connect the selected port to port 3 for receiving or transmitting signals.

Figure 11:
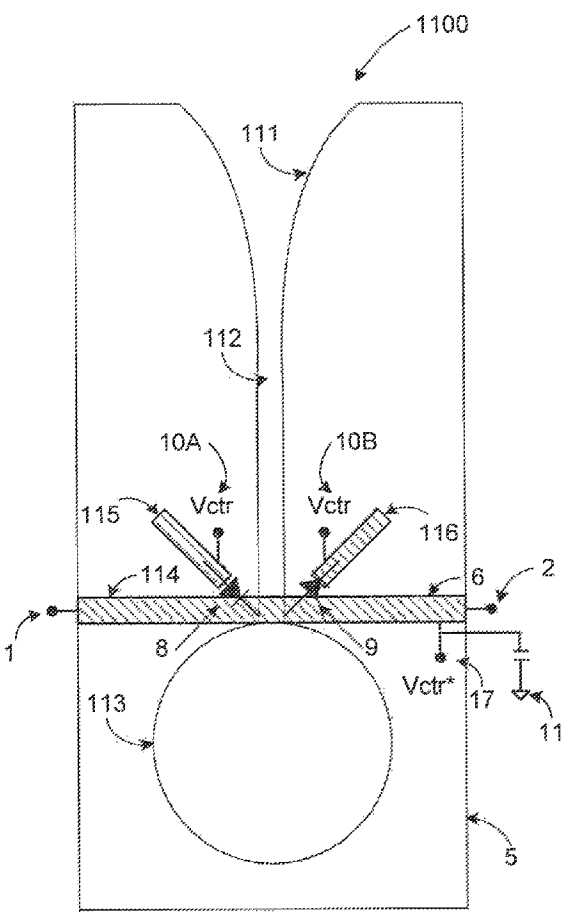
FIG. 11 is a diagram of a still alternative embodiment of a switching component.

FIG. 11 depicts a still further alternative embodiment of switching component 1100. As shown in FIG. 11, trace 5 of switching component 1100 may be formed as a metal plate and integrated with a slot line antenna 111. Slot line antenna 111 includes a slot opening 112 connected to a circular opening 113 disposed in trace 5.

Trace 6 of switching component 1100 may include sections 114-116. Section 114 has an elongated trace disposed perpendicularly to slot opening 112. Sections 115 and 116 are metal stubs similarly to sections 95 and 96 of FIG. 9A. Switching element 8 is coupled between sections 115 and 114, and switching element 9 is coupled between sections 116 and 114. Because antenna 111 is integrated with trace 5, ports 3 and 4 and trace 97 depicted in FIG. 9A are omitted from switching component 1100.

During operation, switching component 216 may select port 1 or 2 according to control signal $V_{ctr}$ or the combination of control signals $V_{ctr}$ and $V_{ctr}$* received through ports 10A, 10B, and 17 and connect the selected port to antenna 111 for transmitting and receiving signals.

Figure 12:
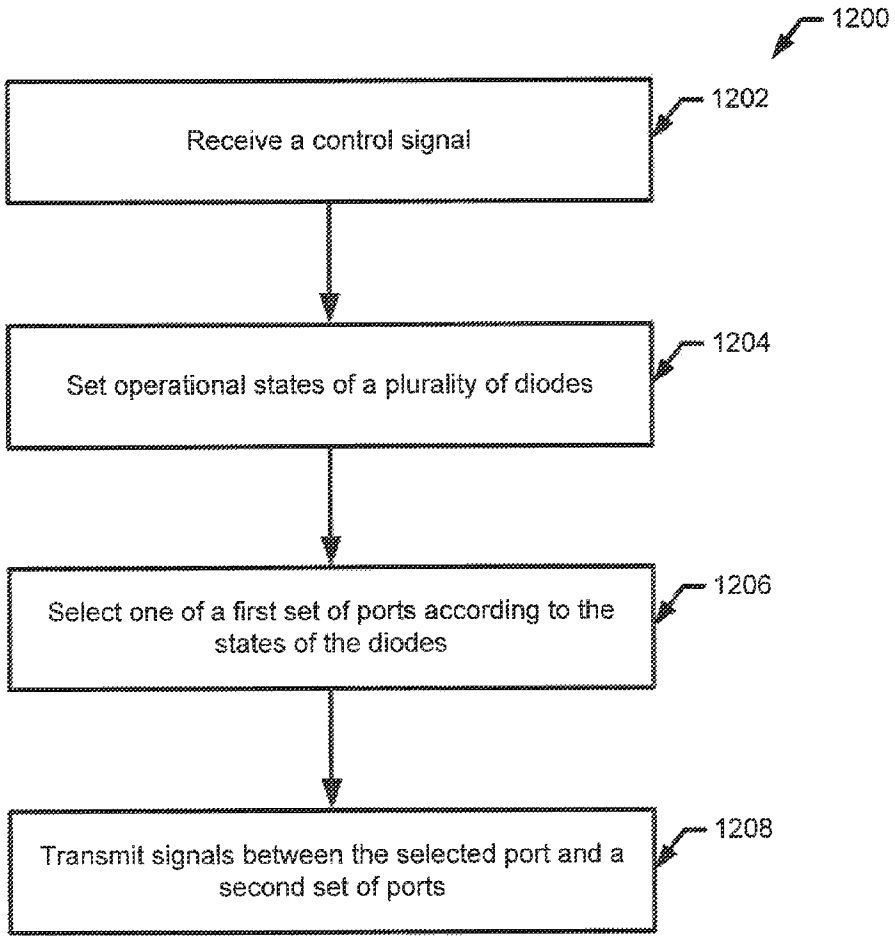
FIG. 12 depicts a flow diagram of a process for selecting one of a set of ports coupled to a first circuit for connection with a second circuit.

FIG. 12 depicts a flow diagram of a process 1200 for selecting one of a set of ports (e.g., ports 1 and 2) coupled to a first circuit (e.g., trace 6) for connection with a second circuit (e.g., trace 5). According to process 1200, a control signal, such as control signals $V_{ctr}$ and $V_{ctr}$*, is received through a control node at step 1202. At step 1204, the operational states of a plurality of switching elements, such as switching elements 8 and 9, are set according to the control signal. For example, as shown in FIG. 3A, when the control signal has a first voltage level, switching element 8 is turned on and switching element 9 is turned off. When the control signal has a second voltage, switching element 8 is turned off and switching element 9 is turned on. The logic may be reversed as discussed in connection with FIGS. 7 and 8.

At step 1206, one of the set of ports may be selected according to the operational states of the switching elements. For example, as shown in FIG. 3A, when switching element 8 is turned on and switching element 9 is turned off, port 1 is grounded through switching element 8 and thus disabled. Since switching element 9 provides an open circuit, port 2 is selected and connected to trace 5 and hence ports 3 and 4. Alternatively, when switching element 8 is turned off and switching element 9 is turned on, port 2 is grounded through switching element 9 and thus disabled. Since switching element 8 provides an open circuit, port 1 is selected and connected to trace 5 and hence ports 3 and 4.

At step 1208, signals are transmitted between the selected port and the second circuit. For example, a signal may be received through the selected port (e.g., port 1 or 2), split into two signal components, and output through ports 3 and 4 as described above in connection with FIG. 3A. Alternatively, signals may be received through ports 3 and 4, combined to form a single signal, and output through the selected port as described above.

The switching components disclosed herein may be orders of magnitude cheaper and may be more versatile than existing solutions. As an example, conventional high power (e.g., greater than 2 Watt), high frequency (e.g., greater than 6 GHz) switch MMICs or integrated chips generally cost $20 or more each, even when manufactured in large quantities. At power levels above 2 Watts and frequencies greater than 12 GHz, the cost per switch can extend to $80 or more for each unit. In embodiments of the present disclosure, however, the primary cost is in the cost of the switching elements (e.g., switching elements 8 and 9). The printed traces may be part of the circuit board of the T/R module and may be manufactured at substantially lower cost than prior known components. Switching elements that support up to 20 GHz and have advantageous performance properties, such as low resistance, low capacitance, and high power handling capability, are readily available at prices of $1.50 to $3.00 each. Also, embodiments of the present disclosure may require only a control input (e.g., the control signal $V_{ctr}$) for selecting port 1 or 2. This leads to less peripheral control circuitry than conventional designs, such as a single pole, double throw (SPDT) switch, which require multiple control inputs and complex circuitry. For systems that employ hundreds if not thousands of T/R modules or other circuits that require high power switches, the disclosed embodiments may provide substantial cost savings.

The embodiments disclosed herein may be integrated in any circuit that requires switching of RF signals and is capable of processing signals above 2 Watts or more. In particular, the switching components may operate at the Ku-band or higher and transmit signals with power level of 4 Watts or more. The power handling capability of the presently disclosed embodiment may be determined by the power handling capability of switching elements 8 and 9 and the ratio of their resistance to that of the input impedance of ports 1 and 2.

Switching element 8 and 9 may operate within the range of 12 GHz to 20 GHz and provide a greater bandwidth than existing switching solutions for a fraction of the cost. For example, for a common input impedance of 50 ohms at ports 1 and 2, the presently disclosed embodiments can handle as much as 10 Watts of input power. For greater input impedances, the embodiments disclosed herein can provide even much greater power handling capability. Switching elements 8 and 9 are usually a fraction of the size of the conventional switches, providing a substantial size advantage.

The conventional high power switches typically generates a 1 to 1.5 dB of power loss at high frequencies, whereas the embodiments disclosed herein have only approximately 0.4 dB of power loss or, in some cases, even less. In high power applications, the disclosed embodiments provide a significant advantage in reducing power loss over the conventional switches. For example, in a T/R module that transmits 2 Watts of signals at the output, a conventional switch requires an output power of at least 2.82 Watts to counter the power loss, whereas the present embodiments require an output power of only 2.19 Watts. This reduction in power loss is significant, considering that the T/R module is typically used in an array of hundreds or thousands of elements, where the power loss is dissipated as heat. For a 256 element array, the conventional switch causes additional 161 Watts of power loss, compared to embodiments disclosed herein.

In addition, a conservative estimate of a HPA's efficiency is 30%. For the above example, a conventional switch would cause the array to dissipate approximately 1894 Watts of heat from circuit. In comparison, the present embodiments may lead to a total dissipation of only 1356 Watts. This is a 28% reduction in power dissipation. As a result, the disclosed embodiments generate much less heat than the conventional switches. The lower power loss provided by the disclosed embodiments also benefits the performance of the T/R module and improves the sensitivity of the T/R module because the loss prior to the LNA is significantly reduced.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A switch for selecting an input/output port, comprising:
a dielectric layer;
a first circuit and a second circuit disposed on opposite sides of the dielectric layer and electronically coupled to each other through the dielectric layer, the first circuit including a set of input/output ports;
a control port for receiving a control signal; and
a plurality of switching elements, the control signal selecting one of the set of input/output ports for connection with the second circuit by setting operational states of the plurality of switching elements;
wherein the first circuit and the second circuit each has a predetermined shape including an outer dimension and an inner dimension, and
wherein the outer dimensions of the first and second circuit are substantially similar and approximately equal to a quarter of a wavelength of a signal at a desired frequency of operation.

2. The switch of claim 1, wherein the predetermined shape is selected from one of a "U" shape, a disc shape, or a rectangular shape.

3. A switch for selecting an input/output port, comprising:
a dielectric layer;
a first circuit and a second circuit disposed on opposite sides of the dielectric layer and electronically coupled to each other through the dielectric layer, the first circuit including a set of input/output ports;
a control port for receiving a control signal;
an additional control port for receiving an additional control signal; and
a plurality of switching elements, the control signal selecting one of the set of input/output ports for connection with the second circuit by setting operational states of the plurality of switching elements;
wherein the dielectric layer has a first surface and a second surface, the first circuit is disposed on the first surface, and the second circuit is disposed on the second surface, and
wherein the set of input/output ports includes at least two input/output ports, and the switching elements are connected between the at least two input/output ports, and
wherein the switching elements include a first switching element and a second switching element connected in series between the at least two input/output ports, and a common node between the first and second switching elements is coupled to a around, and
wherein the control signal and the additional control signal select one of the set of input/output ports for connection with the second circuit by setting the operational states of the switching elements.

4. A switch for selecting an input/output port, comprising:
a dielectric layer;
a first circuit and a second circuit disposed on opposite sides of the dielectric layer and electronically coupled to each other through the dielectric layer, the first circuit including a set of input/output ports;
a control port for receiving a control signal; and
a plurality of switching elements, the control signal selecting one of the set of input/output ports for connection with the second circuit by setting operational states of the plurality of switching elements;
wherein the dielectric layer has a first surface and a second surface, the first circuit is disposed on the first surface, and the second circuit is disposed on the second surface, and
wherein the set of input/output ports includes at least two input/output ports, and the switching elements are connected between the at least two input/output ports, and
wherein the switching elements include a first switching element and a second switching element connected in series between the at least two input/output ports, and a common node between the first and second switching elements is coupled to a around, and
wherein the second circuit includes a printed antenna.

5. A switch for selecting an input/output port, comprising:

a dielectric layer;

a first circuit and a second circuit disposed on opposite sides of the dielectric layer and electronically coupled to each other through the dielectric layer, the first circuit including a set of first input/output ports and the second circuit including a set of second input/output ports for balancing input/output to/from an antenna element;

a control port for receiving a control signal; and a plurality of switching elements, the control signal selecting one of the set of first input/output ports for connection with the second circuit by setting operational states of the plurality of switching elements;

wherein the set of first input/output ports includes at least two input/output ports, and the switching elements are connected between the at least two first input/output ports, and wherein the switching elements include a first switching element and a second switching element connected in series between the at least two first input/output ports, and a common node between the first and second switching elements is coupled to a ground.

6. The switch of claim 5, wherein a first one of the at least two first input/output ports is selected and connected to the second circuit when the control signal has a first voltage level, and a second one of the at least two first input/output ports is selected and connected to the second circuit when the control signal has a second voltage level.

7. The switch of claim 6, wherein the first switching element is turned off and the second switching element is turned on when the control signal has the first voltage level, and the first switching element is turned on and the second switching element is turned off when the control signal has the second voltage level.

8. The switch of claim 5, wherein the first circuit and second circuit substantially overlap each other.

9. The switch of claim 5, wherein:

the second circuit has one or more circular openings connected by a slot opening;

the first circuit includes a plurality of sections;

a first section of the plurality of sections being disposed perpendicular to the slot opening and proximate to one of the circular openings; and a second section and a third section each forming a metal stub;

the first switching element of the plurality of switching elements is connected between the second section and the first section; and the second switching element of the plurality of switching elements is connected between the third section and the first section.

10. The switch of claim 9, wherein the control port is coupled to at least one of the second section and the third section.

11. The switch of claim 9, wherein the first circuit further comprises a fourth section disposed perpendicular to the slot opening.

12. The switch of claim 5, wherein:

the set of first input/output ports are coupled to at least a transmitting channel and a receiving channel; and the set of second input/output ports includes at least one input/output port coupled with at least one antenna.

13. The switch of claim 12, wherein the switch is coupled between the at least one antenna and a T/R module of a phased array for transmitting signals between the antenna and the T/R module.

14. The switch of claim 5, wherein the control port is coupled to the first circuit or to the common node between the switching elements.

15. A method for selecting an input/output port, comprising:

receiving a control signal through a control port;

setting operational states of a plurality of switching elements according to the control signal; and selecting one of a set of input/output ports coupled to a first circuit according to the operational states of the switching elements; and transmitting signals between the selected input/output port and a second circuit;

wherein the second circuit includes at least one input/output port, and the first and second circuits are disposed on a dielectric layer and electrically coupled to each other through the dielectric layer, wherein the at least one input/output port includes two input/output ports providing a balance input/output to an antenna element.

* * * * *